United States Patent [19]

Londaro

[11] Patent Number: 4,733,544

[45] Date of Patent: Mar. 29, 1988

[54] ORNAMENTAL JEWELRY MEMBER

[76] Inventor: Bartholomeo P. Londaro, 69 Carriage Dr., Lincoln, R.I. 02865

[21] Appl. No.: 38,621

[22] Filed: Mar. 23, 1987

[51] Int. Cl.[4] ..... A44C 5/00; A44C 7/00

[52] U.S. Cl. ..... 63/12; 63/11; 63/5.2; 24/161

[58] Field of Search ..... 63/12, 13, 15.45, 15.5, 63/15, 5 A, 15.7, 3; 24/155 R, 161

[56] References Cited

U.S. PATENT DOCUMENTS

| | | | |
|---|---|---|---|
| 177,598 | 6/1917 | Weaver | 63/5 A |
| 204,548 | 6/1878 | Durand | 63/5 A |
| 241,381 | 5/1881 | Krementz | 63/12 |
| 271,121 | 1/1883 | Riley | 63/12 |
| 655,025 | 7/1900 | Simon | 63/5 A |
| 784,823 | 3/1905 | Whitesett | 63/15.45 |
| 1,533,996 | 4/1925 | Olson | 63/15.45 |
| 3,949,754 | 4/1976 | Ferro | 128/330 |
| 3,996,183 | 6/1976 | Mayer | 63/5 A |
| 4,291,551 | 9/1981 | Levine | 63/12 |
| 4,292,715 | 10/1981 | Huddon | 63/13 |
| 4,471,546 | 9/1984 | Bolling | 63/12 |

FOREIGN PATENT DOCUMENTS

| | | | |
|---|---|---|---|
| 65962 | 12/1913 | Switzerland | 63/5 A |
| 1206595 | 9/1970 | United Kingdom | 63/12 |

*Primary Examiner*—Richard J. Johnson

*Attorney, Agent, or Firm*—Salter & Michaelson

[57] ABSTRACT

A jewelry member comprises an elongated, resiliently flexible coil spring element, a jewelry post on one end of the coil spring element and a jewelry clutch on the other end of the coil spring element. The jewelry member can be worn as a pierced earring by passing the post through an aperture in an earlobe of a wearer and then assembling the clutch on the post so that the spring element is retained in a substantially circular ring-like disposition. The jewelry member can alternatively be assembled in end-to-end relation with other similar jewelry members by assembling the post of each jewelry member with the clutch of another jewelry member to form an enlarged ring which can be worn as a necklace or a bracelet.

4 Claims, 4 Drawing Figures

ORNAMENTAL JEWELRY MEMBER

BACKGROUND AND SUMMARY OF THE INVENTION

The instant invention relates to ornamental jewelry and more particularly to an ornamental jewelry member comprising an ornamental, resiliently flexible coil spring element.

Heretofore it has generally been recognized that coil springs can have significant degrees of ornamental value and that they can be effectively included in various jewelry items, such as bracelets and the like. In this regard, it has generally been found that many coil springs inherently have relatively decorative ornamental appearances, particularly when they are secured in substantially circular continuous ring-like dispositions. Further, it has generally been found that jewelry items such as bracelets comprising coil springs which are secured in continuous ring-like configurations can be highly practical since they can easily be expanded to assemble them on and remove them from the wrists of wearers.

However, while heretofore available jewelry members which have comprised coil springs have been found to have relatively high degrees of appeal and popularity due to their inherently ornamental characteristics, they have also generally been found to lack versatility. More specifically, it has been found that because the heretofore-available jewelry members comprising coil springs have been permanently performed into ring-like configurations, they have generally not been adapted to be alternatively assembled in various different types of jewelry items, and they have not been adapted to be embodied as jewelry earrings, particularly earrings which are intended for use on pierced ears.

Jewelry items representing the closest prior art to the subject invention of which the applicant is aware are disclosed in the U.S. Pat. Nos. 204,548 to DURAND and MAYER, SR. 3,966,183. The jewelry items disclosed in these references comprise continuous helical or coil springs which have been permanently formed into continuous, substantially circular ring-like configurations, and they are adapted to be embodied as jewelry items, including finger rings or bracelets. However, since the jewelry items disclosed in these references fail to teach or suggest the novel concepts and structural features of the jewelry member of the subject invention, they are believed to be of only general interest with respect thereto, as will hereinafter be made apparent.

The instant invention provides an effective ornamental jewelry member of the general type which includes an ornamental coil spring element, and it is adapted to be alternatively utilized to form a variety of different types of jewelry items, including earrings, necklaces and bracelets. More specifically, the ornamental jewelry member of the instant invention comprises an elongated, resiliently flexible, ornamental coil spring element having opposite first and second ends, and means which is operable for releasably joining the first and second ends of the coil spring element to thereby releasably retain it in a ring-like disposition. The coil spring element preferably comprises a conventional coil spring element which is movable between a substantially straight, relaxed disposition, and a resiliently stressed, ring-like disposition, and the means for joining the first and second ends of the spring element preferably comprises a male retaining element on the first end of the spring element and a female retaining element on the second end of the spring element, which is operable for releasably receiving the male element therein to releasably join the first and second ends of the spring element. The male retaining element preferably comprises an elongated pierced earring-type post, and it is preferably secured to a first end plate which is attached to the first end of the coil spring element. The female member preferably comprises a conventional jewelry clutch, and it is preferably secured to a second end plate which is attached to the second end of the coil spring element, the clutch preferably being secured to the end plate so that it is disposed in the interior of the coil spring element adjacent the second end thereof. The jewelry member of the subject invention is constructed so that it is alternatively operable as a singular jewelry member or in combination with a plurality of other similar jewelry members to form an enlarged composite jewelry device. In this regard, when the jewelry member is utilized as a singular jewelry member, it can be effectively utilized as a pierced earring by passing the earring post through an aperture in an ear lobe of a wearer and then securing the clutch on the post on the opposite side of the ear lobe so that the post retains the spring element in a substantially circular ring-like disposition. On the other hand, when the jewelry member is utilized in combination with one or more similar jewelry members to form a composite jewelry device, the post of each jewelry member is assembled with the clutch of another jewelry member to form an elongated ring-like jewelry device which can be utilized as either a necklace or a bracelet, depending on the overall or combined length of the individual coil spring element thereof.

Accordingly, it is a primary object of the instant invention to provide a jewelry member comprising a coil spring element having first and second ends which are releasably securable in a joined position to retain the spring element in a substantially ring-like configuration.

Another object of the instant invention is to provide a jewelry member comprising a coil spring element which is adapted for use as a pierced earring.

An even further object of the instant invention is to provide a jewelry device comprising a plurality of coil spring elements which are releasably joined together in end-to-end relation to form a continuous ring.

An even further object of the instant invention is to provide a coil spring-type ornamental jewelry member which has increased versatility.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
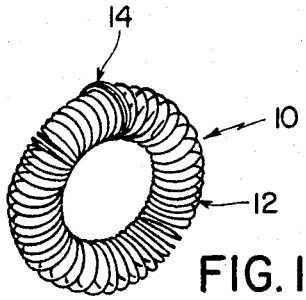
FIG. 1 is a perspective view of the jewelry member of the instant invention.
Figure 3:
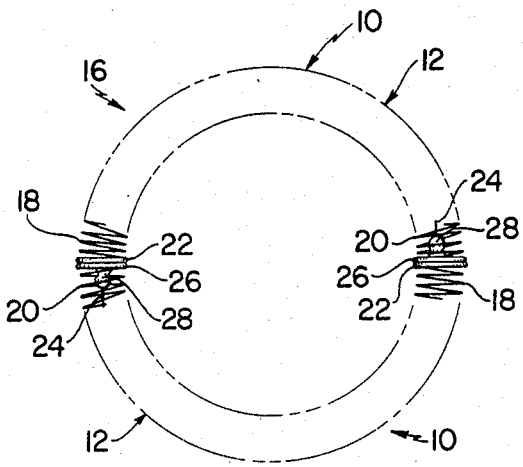
FIG. 3 is an elevational view of a composite jewelry device comprising a plurality of the jewelry members.
Figure 2:
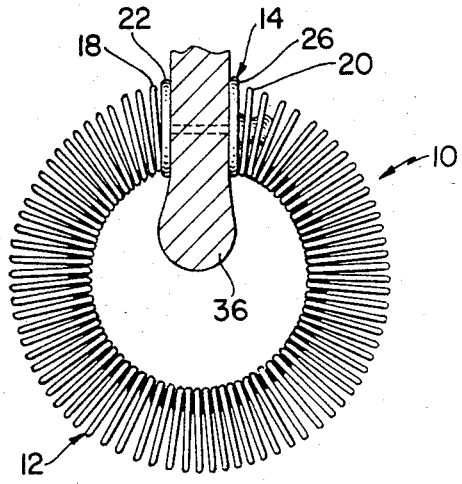
FIG. 2 is an enlarged elevational view thereof mounted on an ear lobe of a wearer.

Referring now to the drawing, the jewelry member of the instant invention is illustrated and generally indicated at 10 in FIGS. 1 and 2, and it comprises a coil spring element generally indicated at 12 and a connecting assembly generally indicated at 14. The jewelry member 10 is alternatively operable as a singular jewelry member for use as a pierced earring in the manner illustrated in FIG. 2 or in combination with one or more additional jewelry members 10 to provide a composite jewelry device such as the bracelet generally indicated at 16 in FIG. 3.

The coil spring element 12 preferably comprises a conventional coil spring element, and it has a first end 18 and a second end 20. The coil spring element 12 is preferably constructed from a suitable resilient metal, such as spring steel, although it preferably comprises a suitable decorative plating or coating to enhance the ornamental appearance of the jewelry member 10. The coil spring element 12 is constructed so that it is resiliently movable between a substantially straight, unstressed disposition wherein the individual coils thereof are substantially uniformly spaced, and a resiliently stressed ring-like disposition wherein the first and second ends 18 and 20 thereof are disposed adjacent one another.

Figure 4:
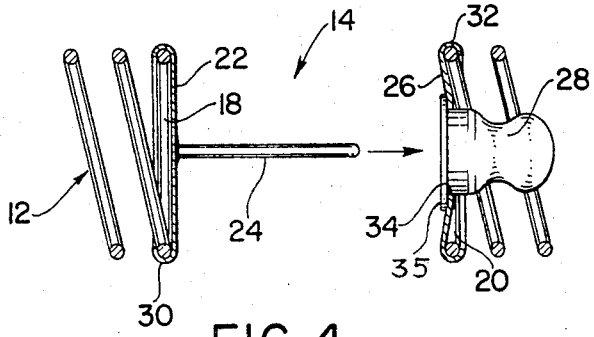
FIG. 4 is a sectional view illustrating the opposite end portions of the jewelry member illustrated in FIG. 2.

The connecting assembly 14 is illustrated most clearly in FIGS. 2 and 4, and it comprises a first end plate 22, a male member or post 24, a second end plate 26, and a female member or clutch 28. The first end plate 22 is of substantially circular configuration, and it is formed with an inwardly curled peripheral rim 30 which is crimped or peened over to capture the adjacent terminal coil of the spring element 12 at the first end 18 in order to thereby permanently secure the end plate 20 to the spring element 12. The post 24 comprises a conventional earring-type post, and it is preferably permanently soldered or welded to the plate 22 in a substantially central location thereon so that it projects beyond the end 18 of the spring element 12 in substantially perpendicular relation to the end plate 22. The post 24 preferably has a diameter which is less than one fourth of the interior diameter of the coil spring element 12. The end plate 26 is preferably also of substantially circular configuration, and it includes an inwardly curled peripheral rim 32 which is crimped or peened over to capture the terminal coil of the spring element 12 at the end 20 in order to permanently secure the end plate 26 thereto. A central aperture 34 is formed in the second end plate 26, and the clutch 28 which also includes a flange 35 is secured to the end plate 26 by peening the plate 26 around the flange 35, whereby the clutch 28 is received in the aperture 34 and the flange 35 faces outwardly from the end 20. The clutch 28 preferably comprises a conventional bullet-type jewelry clutch having a rubberized frictional member (not shown) in the interior thereof for releasably receiving and securing the post 24 therein. The clutch 28 is thus permanently secured to the end plate 26 and is positioned so that the main portion of the clutch 28 is disposed in the interior of the coil spring element 12 adjacent the end 20 and is essentially hidden from view.

For use and operation of the jewelry member 10 as a singular jewelry member, the coil spring element 12 of the member 10 is releasably securable in a substantially circular ring-like disposition such as illustrated in FIGS. 1 and 2 by inserting the post 24 of the member 10 into the clutch 28 thereof to releasably join the first and second ends 18 and 20 thereof. In this regard, when the member 10 is used as a singular jewelry member, it can be effectively utilized as an earring in the manner illustrated in FIG. 2 by inserting the post 24 through an aperture in an ear lobe 36 of the wearer and then assembling the clutch 28 on the post after it has passed through the aperture in the ear lobe 36 so that the end plates 22 and 26 are disposed on opposite sides of the ear lobe 36. Alternatively, the singular jewelry member 10 can be worn as a finger ring or as various other types of jewelry items, depending on the overall length of the coil spring element 12. However, the jewelry member 10 can also be releasably connected in end-to-end relation with other similar jewelry members in the manner illustrated in FIG. 3 to provide a composite jewelry device such as the bracelet 16 or various necklaces. In this regard, the jewelry member 10 can easily be assembled with one or more additional jewelry members 10 by simply inserting the post 24 of each jewelry member 10 into the clutch 28 of another jewelry member 10 to secure the jewelry members together in end-to-end relation so that the first end 18 of each jewelry member 10 is positioned adjacent the second end 20 of another jewelry member 10. In this manner it is possible to make composite jewelry devices, such as the bracelet 16, as well as a variety of other necklaces and/or bracelets of various lengths.

It is seen, therefore, that the instant invention provides an effective coil spring type jewelry member which has a high degree of versatility. The jewelry member 10 can be effectively utilized singularly as a jewlery item such as an earring, and it can be effectively combined with other jewelry members 10 to provide enlarged composite jewelry devices which are effectively adapted for use as bracelets and/or necklaces. Accordingly, it is seen that the instant invention represents a signficant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An ornamental jewelry member comprising an elongated, resiliently flexible, ornamental, helically wound wire coil spring element having opposite first and second ends, a first substantially circular end plate secured to said first end, a substantially cylindrical jewelry post secured to said first end plate, a second substantially circular end plate secured to said second end, and a jewelry clutch secured to said second end plate, said clutch having an aperture therein, said post being dimensioned to be received through an aperture in an earlobe of a wearer and being receivable in said aperture in said clutch for frictionally securing said post in said clutch to releasably join said first and second ends and to thereby secure said jewelry member on said earlobe.

2. In the jewelry member of claim 1, said clutch being received in the interior of said spring element adjacent said second end.

3. An ornamental jewelry member comprising an elongated, resiliently flexible, ornamental, helically wound wire coil spring element having opposite first and second ends, a substantially cylindrical jewelry post, said post having a diameter which is less than one fourth of the interior diameter of said coil spring element, means received in said coil spring element adjacent said first end and securing said post thereto so that it extends outwardly from said first end, a jewelry clutch received in said coil spring element adjacent said second end and means securing said clutch to said coil spring element, said clutch having an aperture therein, said post being dimensioned to be received through an aperture in an earlobe of a wearer and being receivable in said aperture in said clutch for frictionally securing said post in said clutch to releasably join said first and second ends and to thereby secure said jewelry member on said earlobe.

4. An ornamental jewelry device comprising a plurality of ornamental jewelry members, said jewelry members each comprising an elongated, resiliently flexible, ornamental, helically wound wire coil spring element having opposite first and second ends, a first substantially circular end plate secured to the first end thereof, a substantially cylindrical jewelry post secured to the first end plate thereof, a second substantially circular end plate secured to the second end thereof and a jewelry clutch secured to the second end plate thereof, each of said clutches having an aperture therein, each of said posts being dimensioned to be received through an aperture in an earlobe of a wearer, the post of each of said jewelry members being releasably receivable in the aperture in the clutch of another of said jewelry members for releasably connecting said jewelry members in end-to-end relation so that they cooperate to define a substantially ring-like configuration in said jewelry device.

* * * * *

UNITED STATES PATENT AND TRADEMARK OFFICE

CERTIFICATE OF CORRECTION

PATENT NO. : 4,733,544

DATED : March 29, 1988

INVENTOR(S) : LONARDO, Bartholomeo P.

It is certified that error appears in the above-identified patent and that said Letters Patent is hereby corrected as shown below:

Title page:

The name of the inventor/patentee is corrected as follows:

Bartholomeo P. LONARDO

Signed and Sealed this

Fifteenth Day of November, 1988

*Attest:*

*Attesting Officer*

DONALD J. QUIGG

*Commissioner of Patents and Trademarks*